United States Patent [19]

Henriquez

[11] Patent Number: 4,674,595

[45] Date of Patent: Jun. 23, 1987

[54] UNDERWATER ACOUSTIC PRESSURE RELEASE BAFFLE FOR DEPTHS TO 2000 FEET

[75] Inventor: Theodore A. Henriquez, Orlando, Fla.

[73] Assignee: The United States of America as represented by the Secretary of the Navy, Washington, D.C.

[21] Appl. No.: 799,774

[22] Filed: Nov. 20, 1985

[51] Int. Cl.[4] ..... E04B 1/82

[52] U.S. Cl. ..... 181/286; 181/175; 181/288; 181/290; 181/294

[58] Field of Search ..... 181/175, 198, 286, 288, 181/291, 294, 290; 367/152, 162, 176, 188

[56] References Cited

U.S. PATENT DOCUMENTS

| | | | |
|---|---|---|---|
| 3,038,551 | 6/1962 | McCoy et al. | 181/198 |
| 3,136,380 | 6/1964 | McCoy et al. | 181/198 |
| 3,901,352 | 8/1975 | Cluzel | 367/151 X |
| 3,963,094 | 6/1976 | Nowikas | 181/198 |
| 4,090,171 | 5/1978 | Bulzer et al. | 367/151 X |
| 4,301,890 | 11/1981 | Zalas | 181/286 |
| 4,390,976 | 6/1983 | Eynck | 367/151 X |
| 4,399,526 | 8/1983 | Eynck | 367/151 X |
| 4,487,794 | 12/1984 | Brown et al. | 181/291 X |

*Primary Examiner*—Benjamin R. Fuller

*Attorney, Agent, or Firm*—John L. Forrest; Stephen G. Mican

[57] ABSTRACT

A neutrally buoyant, wide frequency range underwater acoustic baffle suitable for extended depth operation comprising a laminated structure including a rigid inner separator sheet having a plurality of uniformly distributed cavities sandwiched between two flexible outer cover sheets and surrounded along its edges with a waterproof seal to completely encapsulate the separator sheet within the cover sheets and waterproof seal. Entrapped air within the air cavities offers a low effective acoustic impedance compared to water, and the rigid inner separator sheet maintains constant separation between the flexible cover sheets, and therefore low acoustic impedance, even under high hydrostatic pressures.

4 Claims, 2 Drawing Figures

UNDERWATER ACOUSTIC PRESSURE RELEASE BAFFLE FOR DEPTHS TO 2000 FEET

BACKGROUND OF THE INVENTION

The present invention is directed to underwater acoustic sensor systems, and more particulary to acoustic baffles for underwater acoustic sensors.

In the design of underwater acoustic systems, it is sometimes necessary to use a reflecting baffle to direct the acoustic signal. The requirements for a good reflector are that the acoustic impedance of the reflector be very much larger or very much smaller than that of water. Reflectors having a much greater impedance than water are very massive and therefore not practical for many applications, such as when the transducer system must be suspended from buoys. Sometimes resonant-type baffles may be used, such as compliant tubes which are made of metal and are hollow with air inside. These baffles are very much less massive than solid baffles of high-density material, but they are only useable over a limited frequency band around which resonance occurs. Very low density materials which have very low acoustic impedance have also been used. These materials, such as cork-rubber compounds or closed cell foam rubber, cannot sustain the hydrostatic pressure of great ocean depth, as they become compressed under pressure and begin to approach the acoustic impedance of water.

OBJECTS OF THE INVENTION

Accordingly, it is an object of the invention is to provide an underwater acoustic baffle having a much smaller impedance than that of water.

Another object of the invention is to extend the frequency range of an underwater acoustic baffle by shifting its resonance frequencies above the acoustic range.

Yet another object of the invention is to increase the pressure and temperature stability of an underwater acoustic baffle.

Still another object of the invention is to neutralize the buoyancy of an underwater acoustic baffle.

A further object of the invention is to fabricate an underwater acoustic baffle with low cost and widely available materials.

A still further object of the invention is to improve the adaptability of an underwater acoustic baffle to a variety of underwater sensor array configurations.

SUMMARY OF THE INVENTION

These and other objects of the invention are achieved by an acoustic baffle comprising two thin flexible sheets sandwiching a rigid inner sheet. The inner rigid sheet is perforated or expanded to create a plurality of air cavities between the outer sheets, and the laminated structure is sealed along its edges to make it airtight and waterproof.

Other objects, features and advantages of the invention will be apparent to those skilled in the art in the description of the preferred embodiment of the invention as described below and also recited in the appended claims.

DESCRIPTION OF THE PREFERRED EMBODIMENT

Figure 1:
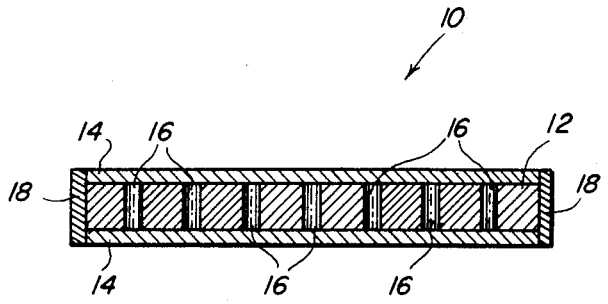
FIG. 1 shows a cross-sectional edgewise view of the invention through the center of the acoustic baffle structure.

Referring to the drawings, wherein like reference characters designate like or corresponding parts throughout the views, FIG. 1 shows a cross-sectional edgewise view of an acoustic baffle 10 according to the invention. An inner separator sheet 12 is sandwiched between two outer cover sheets 14. Evenly distributed cavities 16 are located in the separator sheet 12 and may be formed by using any of the methods well known in the art, such as by perforating or expanding. Separator sheet 12 is chosen to have a thickness and cavities of such a cross-sectional area so as to secure, when combined with said cover sheets 14, any desired degree of buoyancy, as will be evident to those skilled in the art. An example of such a material suitable as the separator sheet 12 is nickel mesh stock, although any of the well known rigid materials may be selected. Outer sheets 14 may comprise any of the well known waterproof materials which may be formed into thin and flexible self-supporting sheets. Examples of suitable materials for cover sheets 14 are ABS GSE-1000 plastic sheet or thin sheet metal stock. The strength and thickness of cover sheets 14 will depend upon the degree of support given by the separator sheet 12 and the maximum hydrostatic pressure that the acoustic baffle 10 is subjected to, as will be apparent to those skilled in the art.

Figure 2:
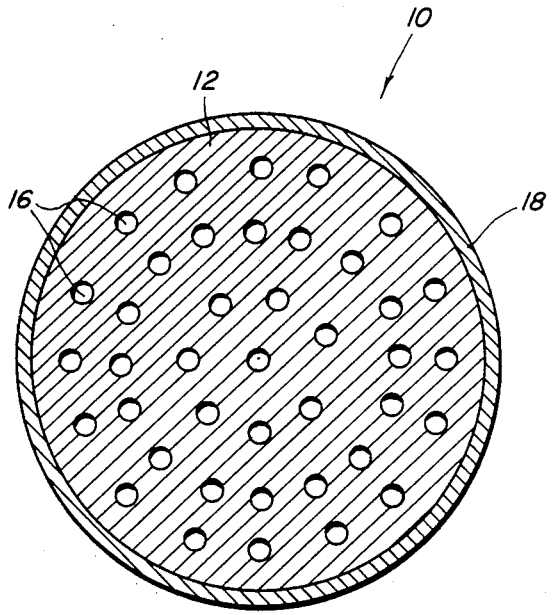
FIG. 2 shows a cross-sectional topward view of the invention through the middle of the acoustic baffle structure.

As shown in FIGS. 1 and 2, cover sheets 14 are connected at their edges to an airtight peripheral seal 18 to completely encapsulate separator sheet 12 within cover sheets 16 and peripheral seal 18. Seal 18 may comprise any of the well known waterproof sealing materials, such as an epoxy filler, or in the alternative, may comprise a liner of waterproof materials bonded or cemented to cover sheets 14 at their edges in a waterproof fashion, using methods well known in the art.

Because the acoustic impedance of air entraped within the cavities 16 is much lower than the impedances of either the separator sheet 12 or the cover sheets 14, the overall acoustic impedance of the acoustic baffle 10 depends primarily upon the ratio of the volume of said entrapped air in the cavities to the surface area of either of the cover sheets, as will be recognized by those skilled in the art.

Although FIGS. 1 and 2 illustrate the acoustic baffle 10 as a circular uniplanar configuration by way of example, the baffle may be constructed according to the invention without regard to shape, size or curvature, as the configuration of any particular sensor system requires.

There has therefore been described an acoustic baffle which combines low effective impedance in water, wide frequency response, resistance to high hydrostatic pressure, neutral buoyancy and conformability of structure.

Because the inner rigid sheet maintains constant separation between the outer sheets even under high hydrostatic pressure, the air cavities within the baffle maintain constant volume, thereby securing low baffle impedance even under high pressure. The rigidity of the baffle structure allows its resonance frequencies to be placed above the acoustic range, thereby giving it a wide operating frequency range. Since the only requirements for fabrication materials are that the inner sheet be of a rigid material and the outer sheets be thin and flexible, low cost and widely available materials may be selected, such as plastic and aluminum. Fabrication materials and sizes of air cavities may be chosen to make the acoustic baffle nearly neutrally buoyant, thereby making the baffle well suited for moored acoustic systems. Finally, because the acoustic baffle structure is comprised of laminated sheets with a plurality of air cavities distributed within it, the baffle may be constructed to have any size or contour that may be required to adapt it to a particular acoustic sensor system.

It will be understood that various changes in the details, materials and arrangements of parts which have been herein described and illustrated in order to explain the nature of the invention may be made by those skilled in the art within the principle and scope of the invention as expressed in the appended claims.

What is claimed and desired to be secured by Letters Patent of the United States is:

1. A reflective acoustic baffle for an underwater acoustic sensor system, comprising:

a rigid metal sheet separation layer having first and second separation layer surfaces, and having a plurality of cavities between said first and second layer surfaces in said separation layer:

a self-supporting flexible waterproof sheet first outer cover layer having a surface adjacent to said first separation layer surface;

a self-supporting flexible waterproof sheet second outer cover layer having a surface adjacent to said second separation layer surface; and a peripheral seal of an epoxy filled material bonding said first and second outer layers to said separation layer at their peripheries.

2. The acoustic baffle structure recited in claim 1, wherein said first and second outer cover layers further comprise said flexible sheets selected from the group of plastic and metal sheet materials.

3. The acoustic baffle structure recited in claim 2, wherein said separation layer further comprises said metal sheet selected from the group of expanded and perforated metal sheets.

4. A reflective acoustic baffle for as underwater acoustic sensor system, comprising:

a nickel mesh separation layer having first and second separation layer surfaces;

a self-supporting ABS GSE-1000 plastic sheet first outer cover layer having a surface adjacent to said first separation layer surface;

a self-supporting ABS GSE-1000 plastic sheet second outer cover layer having a surface adjacent to said second separation layer surface; and an epoxy filler peripheral seal bonding said outer layers to said separation layer at their peripheries.

* * * * *